US008840528B2

(12) United States Patent
Zylstra

(10) Patent No.: US 8,840,528 B2
(45) Date of Patent: Sep. 23, 2014

(54) PORTABLE NECK EXERCISE DEVICE

(71) Applicant: Dirk Zylstra, Ionia, MI (US)

(72) Inventor: Dirk Zylstra, Ionia, MI (US)

( * ) Notice: Subject to any disclaimer, the term of this patent is extended or adjusted under 35 U.S.C. 154(b) by 55 days.

(21) Appl. No.: 13/758,107

(22) Filed: Feb. 4, 2013

(65) Prior Publication Data

US 2014/0221176 A1 Aug. 7, 2014

(51) Int. Cl.
*A63B 23/025* (2006.01)
*A63B 21/02* (2006.01)
*A63B 21/04* (2006.01)

(52) U.S. Cl.
CPC ..... *A63B 21/0442* (2013.01)
USPC ..... 482/10; 482/121

(58) Field of Classification Search
CPC ..... A61H 1/0218; A61H 2001/0233; A61H 2201/1607; A61H 1/0222; A61H 1/0229; A61H 1/0296; A61H 2201/1269; A61H 2201/1642; A61H 2201/165; A63B 21/1645; A63B 21/1663; A63B 23/025; A63B 21/1407
USPC ..... 482/10–11, 124, 129–130; 601/37, 39; 602/32, 36
See application file for complete search history.

(56) References Cited

U.S. PATENT DOCUMENTS

| | | | | | |
|---|---|---|---|---|---|
| 3,721,436 | A * | 3/1973 | Barthel, Jr. | ..... | 482/69 |
| 4,537,393 | A * | 8/1985 | Kusch | ..... | 482/10 |
| 4,645,198 | A * | 2/1987 | Levenston | ..... | 482/10 |
| 4,832,333 | A * | 5/1989 | Lockett | ..... | 482/10 |
| 6,152,857 | A * | 11/2000 | Gonzalez-Leal | ..... | 482/10 |
| 6,267,711 | B1 * | 7/2001 | Hinds | ..... | 482/121 |
| 6,939,269 | B2 * | 9/2005 | Makofsky | ..... | 482/10 |
| 7,468,019 | B2 * | 12/2008 | Zylstra | ..... | 482/10 |

* cited by examiner

*Primary Examiner* — Stephen Crow

(57) ABSTRACT

A portable neck exercising device comprising an adjustable frame that can be securely and removably positioned between two sides of a door frame, a set of pulleys attached to the frame, a head band, and flexible tensioning bands attached to the head band, threaded through the pulleys, and removably connected to the frame using various tensions, such that a user can variably exercise their neck muscles by moving their head, neck, and torso in a variety of directions.

20 Claims, 4 Drawing Sheets

PORTABLE NECK EXERCISE DEVICE

FIELD OF THE INVENTION

This invention relates to neck exercise devices that aid in the exercise and rehabilitation of a person's neck, cervical spine, and adjacent muscular groups. The instant portable configuration allows for easy installation, removal, and mobility, and is used for adjusting the angle and amount of tension that is applied to a person's neck.

BACKGROUND OF THE INVENTION

Neck and spinal injuries have plagued man throughout history. Rehabilitation has always been difficult and often the exercises, devices, and apparati cause more damage to the effected and surrounding areas than actual healing and strengthening. Many devices, machines, and apparati have been developed over the years that would only offer specific directional resistance and be limited to only a certain amount or type of tension. Further, the patient would most often need to travel to and from their place of rehabilitation thereby resulting in many missed therapy sessions. Even if a person had a proper machine in their home, the need exists for that person to exercise away from home also. Therefore, there became an urgent need for a portable exercise device that could provide exercise and adjustable resistances in every direction and motion necessary, including moving ones head from side to side, forward and backward, and rotating from left to right and right to left. Further, there became an urgent need for the ability to monitor, analyze, and adjust the tension. Even further, there became an urgent need to make a device that could be easily disassembled, transported, and reassembled.

The applicant's previous patented apparatus (U.S. Pat. No. 7,468,019) is a device that can be used at home. However it is not sufficiently portable. All previous devices are either too cumbersome, or too complicated.

Previous devices and apparati that do not incorporate the novel features of the instant invention that are within the field include the following:

U.S. Pat. No. 6,152,857

This apparatus is not intended for rehabilitation of the cervical spine, and is difficult to transport.

U.S. Pat. No. 4,789,154

This apparatus is not intended for rehabilitation of the cervical spine, the force needed is provided by other body parts of the user, therefore a person without arms cannot use this device, there is no measurement or calibration of restive/muscle strength, it cannot be used following neck trauma, and it can be dangerous to the cervical spine.

U.S. Pat. No. 4,832,333

This apparatus does not offer measurement or calibration of restive/muscle strength, the force needed is provided by other body parts of the user, therefore a person without arms cannot use the device, and the cervical spine cannot be exercised independently.

U.S. Pat. No. 4,893,808

This apparatus is only for use within a clinic and under supervision, it is used only for diagnostic purposes and not as an exercise machine, it needs electrical wiring, actuators, and counterweights to be operational, and offers limited freedoms of movement.

SUMMARY OF THE INVENTION

This invention essentially consists of an adjustable frame that can be securely and removably positioned between two sides of a door frame, a set of pulleys attached to the frame, a head band, and flexible tensioning bands attached to the head band, threaded through the pulleys, and removably connected to opposite sides of the frame using various tensions, such that when the apparatus is in position within a door frame and the user attaches the head band, they can variably exercise their neck muscles by moving their head, neck, and torso in a variety of directions.

One advantage over prior machines and apparati is that this device is light, simple, portable, and easy to install and uninstall.

Another advantage over the prior machines, devices, and apparati is that this device can provide tension to a user's head in any direction desired, including side to side, forward and backward, and rotating from left to right and right to left, while retaining the appropriate tension at all times.

Another advantage is that the tension can be easily adjusted.

The novel features of the present invention are set forth in the claims herein. The functionality, modes of operation, purposes, and advantages of this invention can be further understood with reference to the following drawings and description of the preferred embodiment.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter which contains illustrated preferred embodiments of the invention.

DETAILED DESCRIPTION OF THE PREFERRED EMBODIMENT

Figure 1:
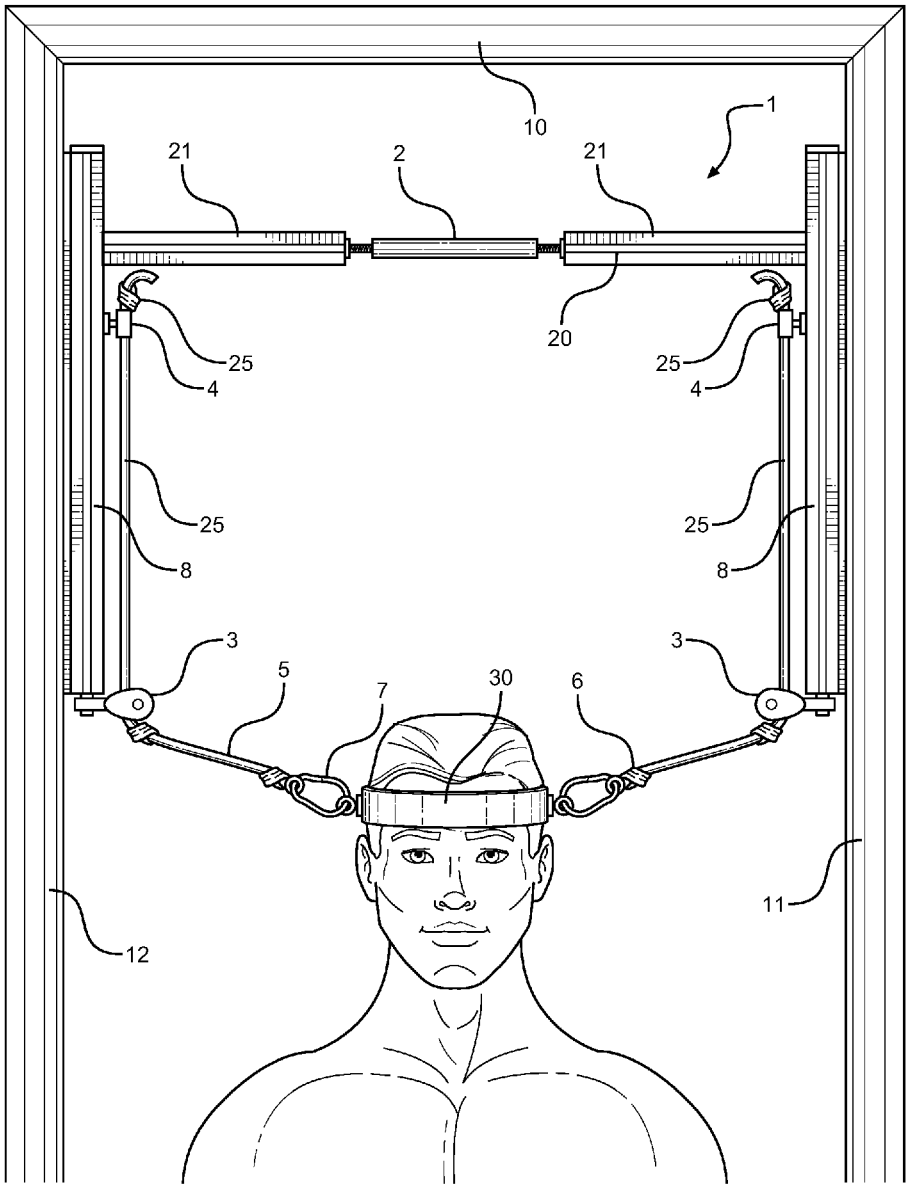
FIG. 1 is a front view of the portable neck exercise device assembled and using tensioning bands attached to the vertical legs, and positioned within a door frame.

As per FIG. 1, the portable neck exercise device comprises an H-shaped frame (1) having two vertical legs (8) adapted to be respectively placed on opposite inner jambs (11 and 12) of a door frame (10), an adjustable horizontal member (20) having two end sections (21) and an adjustable turnbuckle (2) therebetween, such that said H-shaped frame can be adjustably fitted within said door frame and said horizontal member (20) elongated creating a secure frictional hold between the respective vertical legs (8) and said door jambs (11 and 12). The portable neck exercise machine further comprises a pulley member (3) pivotally attached to a lower end of each said vertical leg, a head band (30) designed to comfortably and firmly attach to a person's head, and two flexible tensioning bands (5) each respectively attached to the head band via respective spring clips (7), are threaded through respective pulleys (3), and removably connected to respective vertical legs via knots (25) fitted within slotted tubes (4) attached to each vertical leg, such that when the apparatus is in position within a door frame and the user attaches the head band, they can variably exercise their neck muscles by moving their head, neck, and torso in a variety of directions.

The ability to change the tension within the tensioning bands is accomplished by the choice of which knot (25) is fitted within each slotted tube (4).

Figure 2:
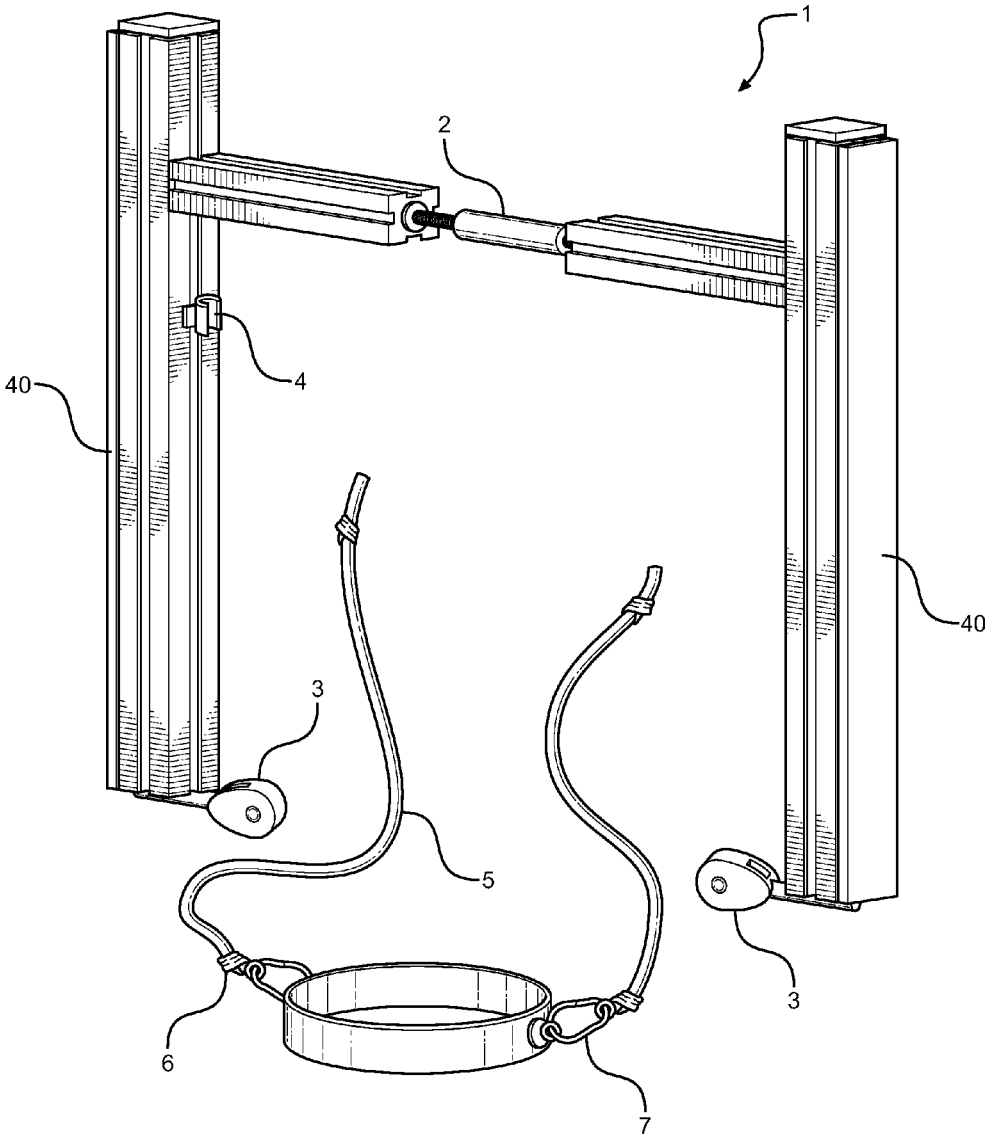
FIG. 2 is a perspective view of the portable neck exercise device.

As per FIG. 2, the surface of the vertical legs (8) that make contact with the jambs of a door frame are covered by a layer of material (40) to prevent damage to the frame, and to increase friction therebetween to keep the device in place during use. This layer of material can be formed from felt, foam, rubber, or any like material that would accomplish the same functions.

Figure 3:
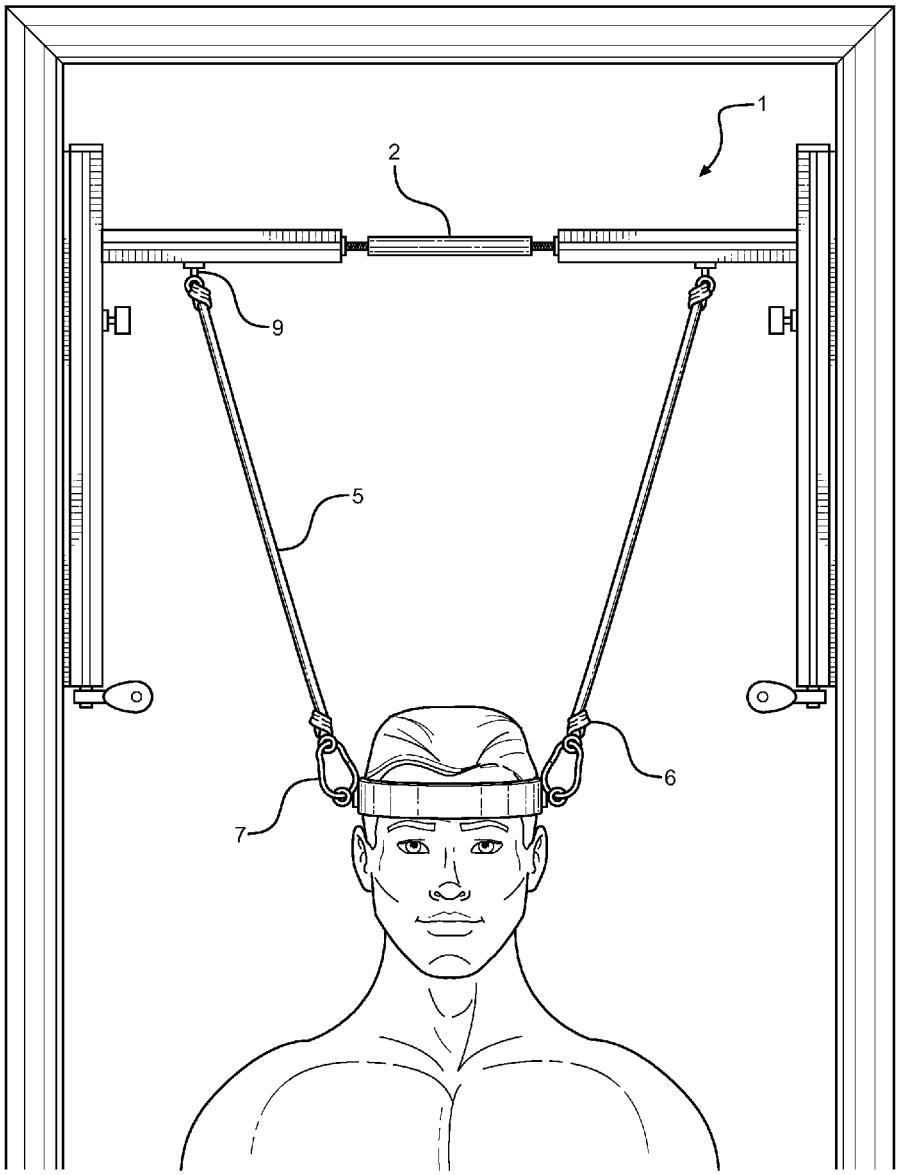
FIG. 3 is a front view of a second embodiment of the portable neck exercise device assembled and using tensioning bands attached to the horizontal beam via eye bolts and positioned within a door frame.

As per FIG. 3, an alternate embodiment incorporates the use of an eye bolt (9) attached to each end section of the horizontal member, and wherein the flexible tensioning bands (5) each respectively attached to the head band via respective spring clips (7) and then connect directly to each respective eye bolt.

Figure 4:
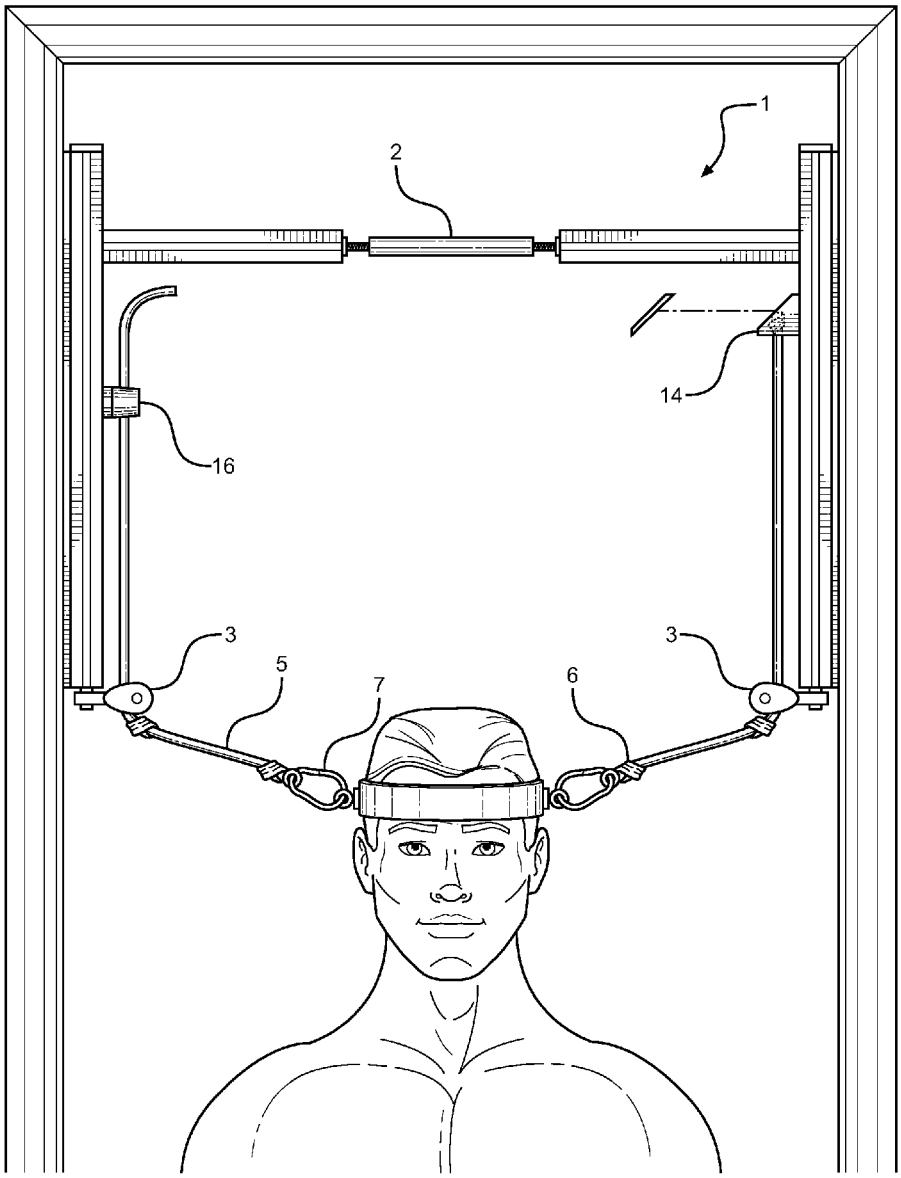
FIG. 4 is a front view of another embodiment of the portable neck exercise device alternately using a V-cleat and/or a corner angle member to adjustably attach each tensioning band a respective horizontal beam.

As per FIG. 4, an alternate embodiment incorporates the use of a corner angle member (14) instead of a slotted tube (4), and which slide lower or higher in the groove of the horizontal member, thereby increasing or decreasing the tension, and thereby resistance, of said flexible tensioning band (5). In following, V-shaped cleat (16) can also be used instead of a slotted tube (4) within the slots of the horizontal members, such that the flexible tension bands can be attached to the legs without the need for knots in the bands.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A portable neck exercise device comprising a frame having two elongated vertical legs adapted to be positioned upon opposite inner jamb surfaces of a door frame, an adjustable horizontal member having two end sections respectively attached to upper sections of said vertical legs, and an adjustable turnbuckle connected in between said two end sections of said horizontal member, such that said frame is adapted to be adjustably fitted within said door frame, and wherein said horizontal member is adjustable lengthwise and adapted to create or release a secure frictional hold between the respective vertical legs and a door frame; a pulley member attached to a lower end section of each said vertical leg; a head band adapted to comfortably and firmly fit onto a person's head; and two flexible tensioning bands each removably attached to said head band, threaded through a respective pulley member, and removably connected to a respective vertical leg, such that when the device is in position within a door frame and the user attaches the head band, they can variably exercise their neck muscles by moving their head, neck, and torso in a variety of directions.

2. The portable neck exercise device of claim 1, wherein each vertical leg includes a slotted tube attached thereto for releasably holding a respective tensioning band therein; wherein said tensioning bands each have a plurality of knots formed thereon in a predetermined spaced apart configuration, such that a person can choose a tensional force on said head band by choosing the appropriate knots to attach to said slotted tubes.

3. The portable neck exercise device of claim 1, wherein each vertical leg includes a V-shaped cleat attached thereto for releasably holding a portion of a respective tensioning band therein, such that a person can choose a tensional force on said head band by choosing which portion of each said tensioning band to place within each respective cleat.

4. The portable neck exercise device of claim 1, wherein each vertical leg includes a corner angle member frictionally connected within a respective groove thereof for releasably holding an end portion of a respective tensioning band, such that a person can choose a tensional force on said head band by releasably sliding said corner angle member within said respective groove.

5. The portable neck exercise device of claim 1, wherein said flexible tensioning bands are respectively removably attached to said head band using spring clips; and wherein each vertical leg includes a cam member attached thereto for releasably holding a respective tensioning band therein.

6. The portable neck exercise device of claim 1, further including an eye bolt attached to each said end section of said horizontal member, such that each said flexible tensioning bands can alternatively be attached from said head band directly to each respective eye bolt, to thereby be adapted to change the direction of tension on a person's neck.

7. The portable neck exercise device of claim 1, wherein the surface of each vertical leg adapted to contact said opposite inner jamb surfaces of said door frame include a layer of material adapted to increase the friction therebetween.

8. The portable neck exercise device of claim 2, wherein said vertical legs are formed having elongated grooves along the lengths thereof, such that said positioning of said horizontal member and said respective slotted tubes can be adjusted.

9. The portable neck exercise device of claim 1, wherein said frame is formed from aluminum.

10. The portable neck exercise device of claim 1, wherein said pulley members are respectively pivotally attached to said lower end sections of each said vertical leg.

11. The combination of a door frame and a portable neck exercise device, said combination comprising a door frame having opposite inner vertical jamb surfaces; and a comprising a frame having two elongated vertical legs adapted to be positioned upon opposite inner jamb surfaces of a door frame; and a portable neck exercise device including an adjustable horizontal member having two end sections respectively attached to upper sections of said vertical legs, and an adjustable turnbuckle connected in between said two end sections of said horizontal member, such that said frame is adapted to be adjustably fitted within said door frame, and wherein said horizontal member is adjustable lengthwise and adapted to create or release a secure frictional hold between the respective vertical legs and said door frame; a pulley member attached to a lower end section of each said vertical leg; a head band adapted to comfortably and firmly fit onto a person's head; and two flexible tensioning bands each removably attached to said head band, threaded through a respective pulley member, and removably connected to a respective vertical leg, such that when the device is in position within said door frame and the user attaches the head band, they can variably exercise their neck muscles by moving their head, neck, and torso in a variety of directions.

12. The combination of claim 11, wherein each vertical leg includes a slotted tube attached thereto for releasably holding a respective tensioning band therein; wherein said tensioning bands each have a plurality of knots formed thereon in a predetermined spaced apart configuration, such that a person can choose a tensional force on said head band by choosing the appropriate knots to attach to said slotted tubes.

13. The combination of claim 11, wherein each vertical leg includes a V-shaped cleat attached thereto for releasably holding a portion of a respective tensioning band therein, such that a person can choose a tensional force on said head band by choosing which portion of each said tensioning band to place within each respective cleat.

14. The combination of claim 11, wherein said flexible tensioning bands are respectively removably attached to said head band using spring clips; and wherein each vertical leg includes a cam member attached thereto for releasably holding a respective tensioning band therein.

15. The combination of claim 11, further including an eye bolt attached to each said end section of said horizontal member, such that each said flexible tensioning bands can alternatively be attached from said head band directly to each respective eye bolt, to thereby be adapted to change the direction of tension on a person's neck.

16. The combination of claim 11, wherein the surface of each vertical leg adapted to contact said opposite inner jamb surfaces of said door frame include a layer of material adapted to increase the friction therebetween.

17. The combination of claim 12, wherein said vertical legs are formed having elongated grooves along the lengths thereof, such that said positioning of said horizontal member and said respective slotted tubes can be adjusted.

18. The combination of claim 11, wherein said frame is formed from aluminum.

19. The combination of claim 11, wherein said pulley members are respectively pivotally attached to said lower end sections of each said vertical leg.

20. A portable neck exercise device comprising an H-shaped frame formed from hollow tubing having a square cross-section, said H-shaped frame including two elongated vertical legs each having a groove on at least one side and extending the length thereof, wherein each vertical leg includes a slotted tube attached within said groove and is adjustably attached therein, said vertical legs adapted to be positioned upon opposite inner jamb surfaces of a door frame, an adjustable horizontal member having two end sections respectively attached to upper sections of said vertical legs via respective said grooves, and an adjustable turnbuckle connected in between said two end sections of said horizontal member, such that said frame is adapted to be adjustably fitted within said door frame, and wherein said horizontal member is adjustable lengthwise and adapted to create or release a secure frictional hold between the respective vertical legs and said door frame; a pulley member pivotally attached to a distal lower end of each said vertical leg; a head band adapted to comfortably and firmly fit onto a person's head, said head band including two O-rings fixedly attached to opposite side thereof; and two flexible tensioning bands each removably attached to said O-rings of said head band, threaded through a respective pulley member, and removably connected to a respective slotted tube, wherein said tensioning bands each have a plurality of knots formed thereon in a predetermined spaced apart configuration, such that a person can choose a tensional force on said head band by choosing the appropriate knots to attach to said slotted tubes; and further including an eye bolt attached to each said end section of said horizontal member, such that each said flexible tensioning bands can alternatively be attached from said head band directly to each respective eye bolt, to thereby be adapted to change the direction of tension on a person's neck, and such that when the device is in position within a door frame and the user attaches the head band, they can choose between attaching the flexible tensioning bands to the slotted tubes through said pulleys, or attaching directly to respective eye bolts to variably exercise their neck muscles by moving their head, neck, and torso in a variety of directions.

* * * * *